United States Patent [19]

Kessler

[11] Patent Number: 4,846,247

[45] Date of Patent: Jul. 11, 1989

[54] SILENT TAMBOUR SLATS

[76] Inventor: Gerald Kessler, 302 McClurg Rd., P.O. Box 389, Youngstown, Ohio 44501

[21] Appl. No.: 243,103

[22] Filed: Sep. 7, 1988

[51] Int. Cl.[4] ..... E06B 9/14

[52] U.S. Cl. ..... 160/235; 160/40; 160/236

[58] Field of Search ..... 160/232, 235, 236, 201, 160/40; 312/297

[56] References Cited

U.S. PATENT DOCUMENTS

| | | | |
|---|---|---|---|
| 847,681 | 3/1907 | McCloud | 160/235 X |
| 2,835,324 | 5/1958 | Taormina et al. | 160/132 |
| 3,424,222 | 1/1969 | Stoner et al. | 160/40 |
| 3,472,305 | 10/1969 | Lefes | 160/236 |
| 3,814,493 | 6/1974 | Radke | 312/297 |
| 4,128,120 | 2/1978 | Frey | 160/191 |
| 4,379,480 | 4/1983 | Kempel et al. | 160/201 X |
| 4,630,664 | 12/1986 | Magro | 160/232 |
| 4,771,816 | 9/1988 | Clay, Jr. | 160/235 |

FOREIGN PATENT DOCUMENTS

| | | | |
|---|---|---|---|
| 1659464 | 10/1969 | Fed. Rep. of Germany | 160/235 |
| 2814825 | 10/1978 | Fed. Rep. of Germany | 160/232 |
| 2806114 | 8/1979 | Fed. Rep. of Germany | 160/232 |
| 3312708 | 10/1984 | Fed. Rep. of Germany | 160/232 |
| 1370435 | 7/1964 | France | 160/236 |
| 2141769 | 1/1985 | United Kingdom | 160/235 |

*Primary Examiner*—Ramon S. Britts
*Assistant Examiner*—David G. Kolman
*Attorney, Agent, or Firm*—Browdy and Neimark

[57] ABSTRACT

A hard plastic tambour slat commonly used in roll-up doors is made silent when contact is made with neighboring slats by the addition of some soft plastic at one or more of the contact points of the slat with adjacent slats.

8 Claims, 1 Drawing Sheet

SILENT TAMBOUR SLATS

FIELD OF THE INVENTION

This invention relates to tambour slats such as those used in roll-up doors, and more particularly to an improved tambour slat construction which has improved noise reduction properties.

BACKGROUND OF THE INVENTION

"Tambour Slats" is the term used to describe slats that slide together to make roll-up doors, such slats having been in use for many years. Tambour doors were once a common sight when roll-top desks were popular. Nowadays, even though roll-top desks have made a nostalgic comeback, the use of tambour slats in roll-top desks is only a very minor use of these slats. Thus, the overall use of tambour slats has increased due to such common needs as garage doors, truck doors, store front doors commonly used in shopping malls, office cabinet doors especially for computer accessories and various other uses both indoor and outdoor. Typical constructions are shown in the U.S. Pat. Nos. 4,128,120 to Frey and Magro 4,630,664.

A substantial problem which almost invariably occurs with the use of tambour slats is the distracting and disturbing clatter-like noise which is produced when a tambour closure such as a door made up of a series of tambour slats is opened or closed. This problem is a particular annoyance in quiet, serene settings such as in hospitals, homes, shops, computer environments, residential neighborhoods and shopping malls where the typical noise created by tambour doors is likely to be disturbing and grating.

SUMMARY OF THE INVENTION

Accordingly, objects of the present invention are to reduce noise pollution and to overcome defects in the prior art, such as indicated above.

Another object of the present invention is to provide a tambour closure which can be opened and closed silently.

A further object of the present invention is to provide a tambour slat which has improved sound damping means when the slat is used in a normal manner.

A still further object of the present invention is to provide a soft contact area at one or more of the contact points of the tambour slat to reduce or eliminate the noise created by the contact between adjacent tambour slats during rolling (opening) and unrolling (closing) of the tambour closure.

The above mentioned objects as well as further advantages of the present invention will become more apparent from the following detailed description of the certain preferred embodiments of the invention taken in conjunction with the drawing wherein:

DESCRIPTION OF THE PREFERRED EMBODIMENTS

Figure 1:
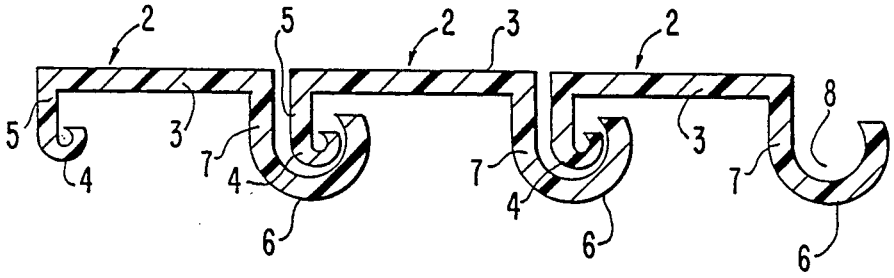
FIG. 1. (PRIOR ART)
FIG. 1 is a cross-sectional view of three interconnected tambour slats of a representative typical tambour closure of the prior art.

Referring now to FIG. 1, there is shown a series of three interconnected prior art slats 2. These slats are typically made out of hard plastic, e.g. rigid vinyl chloride polymer, such as by extrusion. Each slat 2 of this typical construction has a planar portion 3 with a small engaging curl 4 at one end at the distal edge of a first flange 5 and a large engaging curl 6 at the distal edge of a second flange 7 at the opposite end of the planar portion 3. The small engaging curl 4 is small enough to rotatably fit within the hollow of the large engaging curl 6 of the next tambour slat. The slats 2 are interconnected by sliding each small curl 4 into the hollow 8 of the large curl 6 of the neighboring slat. There is enough room between the small engaging curl 4 and the large engaging curl 6 so that they may rotate relative to one another. Thus, the outside surface of the small curl 4 and the inside surface of the large curl 6 constitute slidingly engaging surfaces. When many of the tambour slats 2 are interconnected they form a rolling door.

Figure 2:
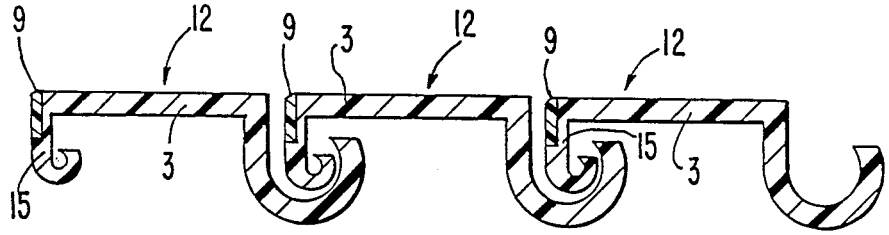
FIG. 2 is a cross-sectional view of three interconnected tambour slats of the style of FIG. 1 modified in accordance with one embodiment of the present invention.

In accordance with the present invention, a typical prior art hard plastic slat 2 such as that of FIG. 1 is modified so that a soft strip of plastic 9 is placed in at least one of the contact zones between the modified slats 12 as shown in FIG. 2. For purposes of illustration, the overall configuration, exclusive of the cushioning strip 9, is the same as in the prior art as shown in FIG. 1. Thus, a tambour closure according to the invention includes a plurality of longitudinally extending tambour slats 12, each having a central body portion 3, a first connector edge along one side of the body portion 3 and a second connector edge along a second side of the body portion 3, adjacent tambour slats 12 being rotatably connected by interengagement of a first connector edge of a first tambour slat with a second connector edge of a second tambour slat. In the embodiment of FIG. 2, the cushioning strip 9 is positioned along an outside corner between the body portion 3 and one of the connector edges as represented by the flange 15.

The tambour slats in accordance with the present invention, such as slat 12 of FIG. 2, is preferably formed of what is commonly known as dual durometer co-extrusion. The body portion 3 and the flanges are extruded of hard plastic such as hard vinyl polymer, while the soft and resilient strip 9 is co-extruded of a soft compatible plastic, such as flexible vinyl polymer. Of course, other compatible plastics can be co-extruded in a known manner.

Figure 3:
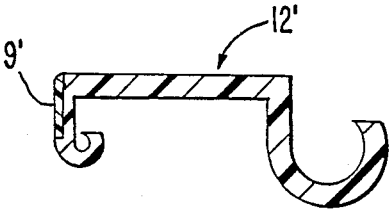
FIG. 3 is a cross-sectional view of a variation of the tambour slat shown in FIG. 2.

FIG. 3 shows a tambour slat 12′ which is a variation of that of FIG. 2, and wherein the cushioning strip 9′ is larger than the strip 9 of the FIG. 2 embodiment. The embodiment 12′ thus illustrates the fact that considerable variation is possible relative to the size and the shape of the cushioning strip.

Figure 4:
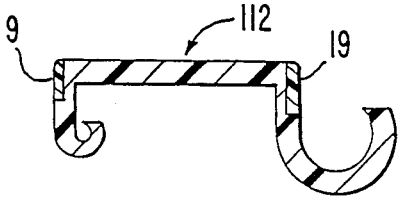
FIG. 4 is a cross-sectional view of an alternative embodiment of a tambour slat in accordance with the present invention.

FIG. 4 shows yet another embodiment 112 having a plurality of cushioning strips 9 and 19, placed in different locations. In both cases, it will be understood that the cushioning strip is located in a zone where contact between adjacent slats normally occurs, and in which such contact in a conventional slat will produce a clattering noise. It will be understood that while the tambour slat 112 of FIG. 4 shows two such cushioning strips, a fewer number or a greater number can be used. For example, it is entirely feasible to eliminate the cushioning strip 9, and rely solely on the cushioning strip 19; or vice versa.

Figure 5:
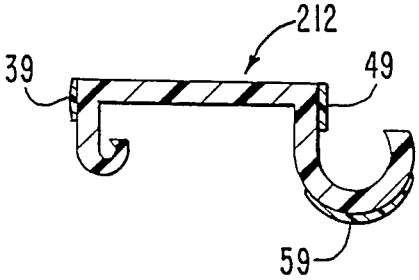
FIG. 5 is a cross-sectional view of a further alternative embodiment of a tambour slat in accordance with the present invention.

FIG. 5 shows yet another embodiment 212 wherein the cushioning strips 39, 49 and 59 are each provided as an additional thickness, this construction also being formed by dual durometer co-extrusion. While the cushioning strips 39 and 49 are generally in the same location, respectively, as the cushioning strips 9 and 19 in the embodiment of FIG. 4, it will be seen that cushioning strip 59 is provided in a different location. Again, the location of the cushioning strip depends on design and functional considerations, it being understood that the product must be attractive, and that the one or more cushion strips provided must be in a location where the soft cushioning strip is able to damp and eliminate the usual unpleasant noise which is otherwise normally created when rolling or unrolling tambour closures.

Thus, it is to be understood that the present invention is intended to cover use of cushioning strips of any size formed at any contact zones, such as by dual durometer co-extrusion, as may be needed on any tambour slat of any construction, such a cushioning strip constituting means to dampen the noise caused by contact made between adjoining tambour strips.

Although dual durometer extrusion of compatible materials provides the preferred constructions according to the invention, other possibilities exist.

It is to be understood that the invention is not limited to the embodiments disclosed which are illustratively offered and that modifications may be made without departing from the invention.

What is claimed is:

1. In a tambour closure comprising a plurality of longitudinally extending tambour slats each having a central body portion, a first connector edge along one side of said body portion and a second connector edge along a second side of said body portion, adjacent tambour slats being rotatably connected by interengagement of a slidingly engaging surface of a first connector edge of a first tambour slat with a slidingly engaging surface of a second connector edge of a second tambour slat, the improvement comprising:

cushion means on said tambour slats for cushioning and damping contact between adjacent slats and for reducing noise upon opening and closing of said tambour closure, said cushion means being located on a surface of said first or second connector edge other than said slidingly engaging surfaces.

2. A tambour closure according to claim 1 wherein said cushion means comprises at least one cushion strip extending longitudinally of said tambour slat.

3. A tambour closure according to claim 2 wherein said cushion strip is dual durometer co-extruded of soft plastic with said tambour slat.

4. A tambour closure according to claim 3 wherein said first or second connector edge on which said cushion means is located has a given thickness, said cushion strip being recessed in said thickness.

5. A tambour closure according to claim 1 wherein said cushion means comprises a plurality of cushion strips extending longitudinally of said tambour slat.

6. A tambour closure according to claim 5 wherein each said cushion strip is dual durometer co-extruded of soft plastic which said tambour slat.

7. A tambour closure according to claim 5 wherein one said cushion strip is located on said first connector edge and a second cushion strip is located on said second connector edge.

8. A tambour closure according to claim 7 wherein at least one of said cushion strips is recessed within its respective connector edge.

* * * * *